US005688131A

United States Patent [19]

Byfield, Jr.

[11] Patent Number: 5,688,131

[45] Date of Patent: Nov. 18, 1997

[54] MULTI-USE ELECTRICAL CONNECTOR

[75] Inventor: Dwight Byfield, Jr., Fresno, Calif.

[73] Assignee: Wirth Co Engineering, Inc., Minneapolis, Minn.

[21] Appl. No.: 706,872

[22] Filed: Sep. 3, 1996

[51] Int. Cl.[6] ..... H01R 4/66

[52] U.S. Cl. ..... 439/92; 439/883

[58] Field of Search ..... 439/883, 868, 439/92, 755, 766, 907

[56] References Cited

U.S. PATENT DOCUMENTS

| | | | |
|---|---|---|---|
| 2,439,947 | 4/1948 | Pontius | 439/868 |
| 4,354,726 | 10/1982 | Kato et al. | 439/907 |
| 4,371,230 | 2/1983 | Inoue . | |
| 4,797,111 | 1/1989 | Ackmann | 439/755 |
| 5,037,317 | 8/1991 | Schwenk et al. | 439/92 |

FOREIGN PATENT DOCUMENTS

| | | | |
|---|---|---|---|
| 6076867 | 3/1994 | Japan | 439/92 |

*Primary Examiner*—Gary F. Paumen
*Attorney, Agent, or Firm*—Roger W. Jensen

[57] ABSTRACT

An electrical terminal connector having a flat base portion with at least one male terminal connection tab depending from one side of the base portion, and a slot in the base portion extending from the edge of a second side of the base portion.

11 Claims, 2 Drawing Sheets

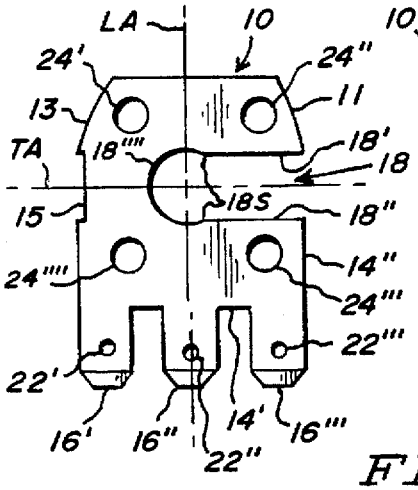
FIG. 1
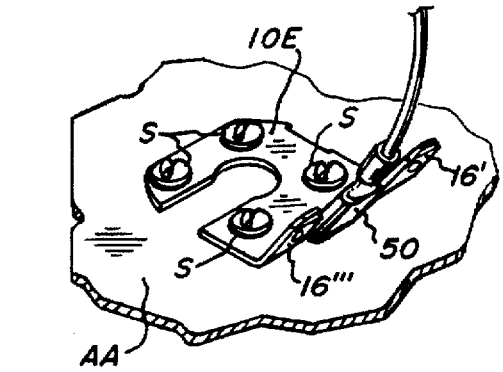
FIG. 1A
FIG. 2
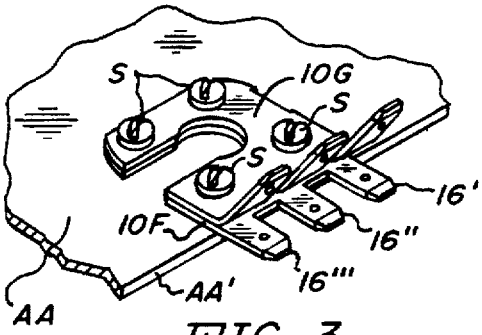
FIG. 3
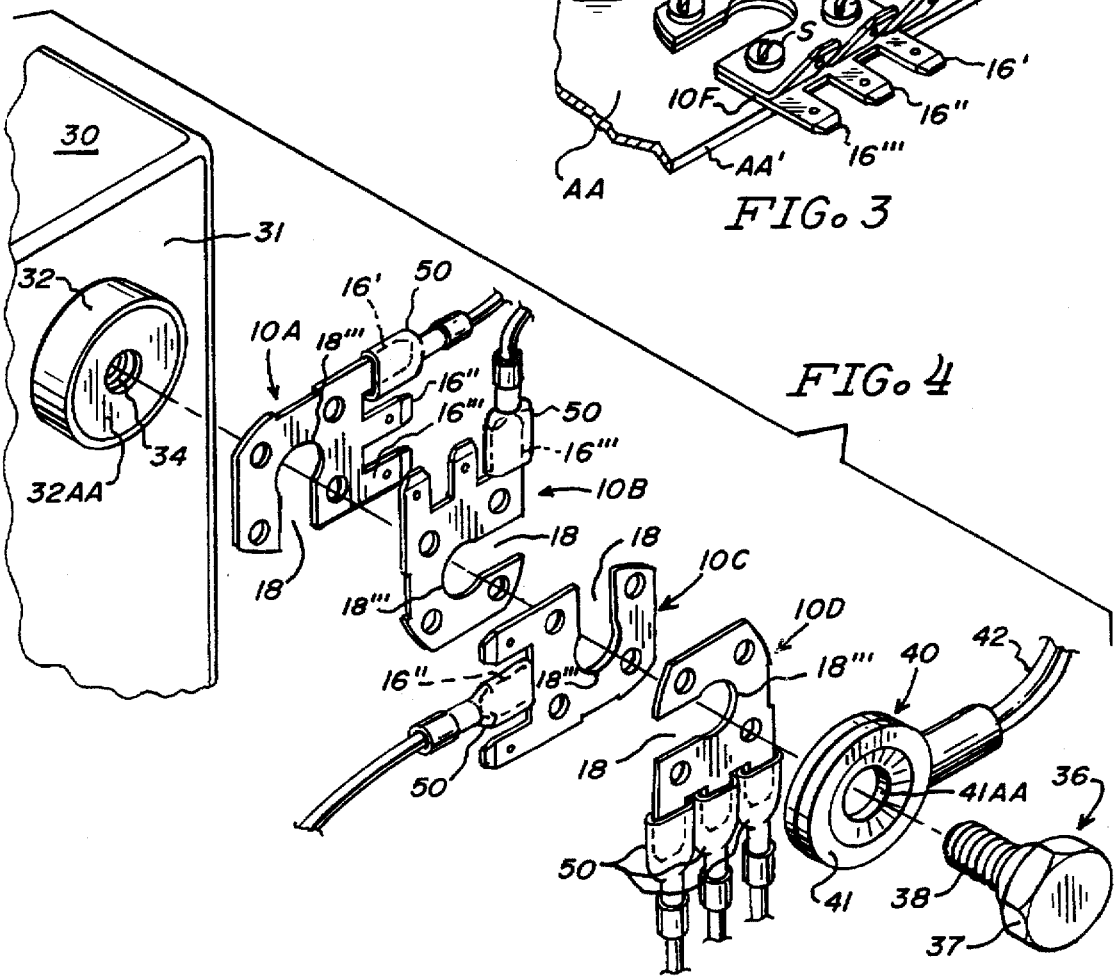
FIG. 4

MULTI-USE ELECTRICAL CONNECTOR

FIELD OF THE INVENTION

This invention relates to a multi-use electrical connector, one of the several possible uses of same being as a connector to a terminal for a side-mount electric storage battery, a second use being as a connector to a terminal on a top-mount electric storage battery, and a third use being as a connector for electrical connection to a metallic frame member such as the frame or body of an automobile.

BACKGROUND OF THE INVENTION

There are, of course, numerous prior art electrical connectors. For example, U.S. Pat. No. 4,797,111 discloses a terminal for a side-mount battery, the terminal being a special bolt for securing a vehicle battery cable in place against the battery terminal of a side-mount battery, the bolt having four arms extending radially to serve as connection or attachment points for accepting an alligator clamp of a jump cable.

Another prior art connector is disclosed in U.S. Pat. No. 4,371,230. This patent teaches having one or more flat ring-shaped connectors having a bolt hole with a tab extending radially outwardly from the ring-shaped terminal portion. This patent specifically teaches the stacking of these terminals. Further, FIGS. 1–3 of U.S. Pat. No. 4,371,230 show examples of prior an terminals.

SUMMARY OF THE INVENTION

The present invention has several advantages over all known prior art connectors; it provides a low-cost multi-use electrical connector which, in one application, can be used either singly or severally as a means for an electrical connection with a threaded female battery terminal of a side-mount electrical storage battery having a battery terminal bolt threaded into the battery tap. Another application of my unique practical connector is for it to be used either singly or severally as a means for an electrical connection to a terminal of a top-mount electric storage battery. A third possible use of the unique connector is for establishing electrical connection to a metallic frame member, such as the frame or body of an automobile.

For all these, as well as other applications, in the preferred embodiment, the connector of this invention comprises a four-sided flat metal base portion having a preselected thickness and longitudinal and transverse axes. The base portion has at least two terminal connection tabs depending or extending from one side of the base portion. The tabs extend parallel to the longitudinal axis and are tranversely spaced apart from one another to provide space for selective attachment thereto of female terminal connectors. In addition, the base portion has a slot which extends from the edge of a second side, extending parallel to the transverse axis. The slot has a preselected width so as to fit over a battery terminal bolt. The slot extends to the center of the base portion and terminates at a centrally positioned hole in the base portion.

The connector, for the side-mourn battery end use or application, may be quickly electrically connected to the battery by first loosening the battery bolt a few turns in the female battery terminal. Then the connector is positioned immediately adjacent to the female threaded battery terminal with the centrally positioned hole of the connector at the terminus of the slot being closely adjacent to the battery bolt, following which the battery bolt is then tightened in the female terminal.

As will be explained in more detail below, the connector may be used as a connector to a terminal on a top-mount type electric storage battery.

For another and separate end use, the base portion is additionally provided with at least two and preferably four grounding holes therethrough. In the preferred embodiment, the four grounding holes are arranged in two sets of two each, with all four grounding holes being equidistant from the center of the centrally positioned hole of the slot, with each set of two holes being on opposite sides of the slot and with the two holes of each set being on a line parallel to the transverse axis.

Applicant's connector can be used, as aforesaid, as a means for electrical connection or grounding to a metallic frame member, the procedure being very simple by abutting the base portion against the metallic frame member and then fixing the base portion to the frame member by use of fastening means such as sheet metal screws inserted through said grounding holes and screwed into the metallic frame member.

An alternate method of fixing the base portion of the connector to the frame member is to use a single fastening means such as a large sheet metal screw inserted through the centrally positioned hole of the slot of the connector and screwed into the metallic frame member.

For all of the above-described applications or uses of my invention, there is additional versatility. Depending upon the number of external wires to be connected, it may be desirable to use a plurality of my connectors stacked one adjacent to another, with the male tabs being rotated about the axis of the centrally positioned hole. Further, the male tabs may be in the plane defined by the flat base portion or, for some applications, it is advantageous to have the male tabs bent or angled from the aforesaid plane to facilitate connection thereto of female connectors. For some applications it is advantageous to have the male tabs angled at approximately 45° from the plane defined by the flat base portion.

BRIEF DESCRIPTION OF THE DRAWINGS

FIG. 1 is a plan view of the multi-use electrical connector of this invention.

FIG. 1A is a side view of the connector shown in FIG. 1.

FIG. 2 shows a perspective view of my electrical terminal connector being used as a means for providing an electrical connection to a metallic frame member, the male tabs being angled away from the plane of the flat base portion at an angle of approximately 45°.

FIG. 3 shows a variation of the arrangement of FIG. 2 wherein two stacked flat connectors are connected to a metallic frame member, the male tabs on the connector closest to the frame being horizontal, and the male tabs of the upper connector being angled at about 45°.

FIG. 4 is an exploded isometric view of the connector being used as a means for electrical connection with a threaded tap battery terminal of a side-mounted electrical storage battery.

DETAILED DESCRIPTION OF THE INVENTION

Figure 5:
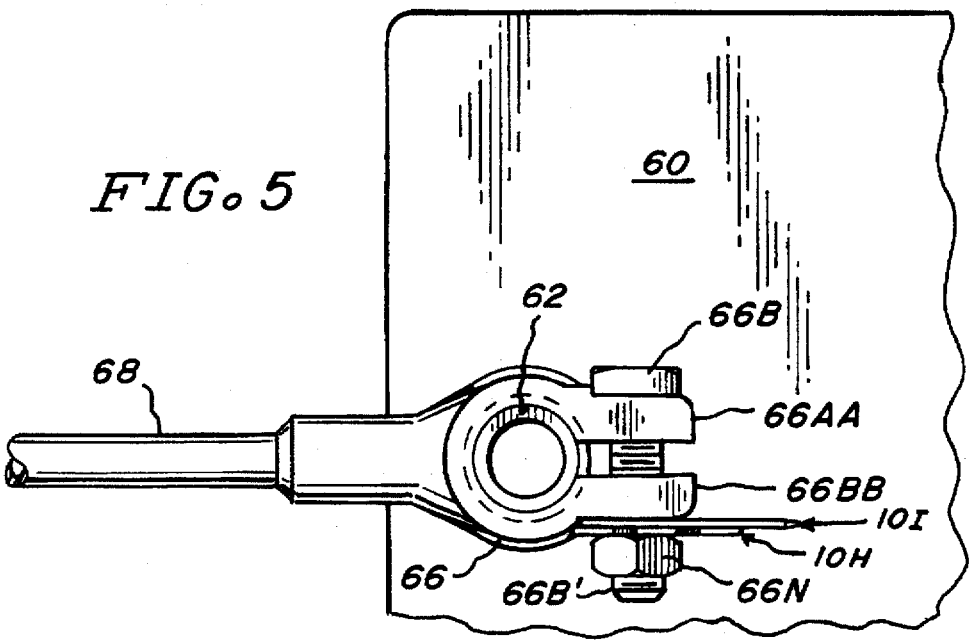
FIGS. 5 and 6 show, respectively, top and side views of the connector being used as a means for electrical connection with a battery terminal of a top-mount electric storage battery.

Referring to FIGS. 1 and 1A, the reference numeral 10 designates a four-sided flat metal base portion 12 having a preselected thickness shown in FIG. 1A. The base portion has a longitudinal axis LA and a transverse axis TA. The reference numeral 14' designates one of the four sides, more specifically, the side at the bottom of the base portion as depicted in FIG. 1, this side being parallel to the transverse axis TA. A second side 14" lies generally parallel to the longitudinal axis LA.

A plurality of male terminal connection tabs 16', 16", and 16' depend from side 14" of the base portion; these male tabs extend generally parallel to the longitudinal axis LA and the tabs are further transversely spaced apart from one another to provide sufficient clearance for the connection thereto of one or more female terminal connectors 50 such as is shown in FIG. 2. Each of the tabs 16'–16'" has a small aperture or hole 22'–22'" respectively, generally centrally positioned in the tab as is clearly shown in FIG. 1; holes 22'–22'" are well known to those skilled in the art for facilitating a partial locking action between a male tab and a co-acting female connector.

A slot 18 having sides 18' and 18" extends from the edge of a second side 14" of the base portion. As depicted, the surfaces 18' and 18" are generally parallel to the transverse axis TA although, in some embodiments, the surfaces 18' and 18" could be at a preselected angle with respect to the transverse axis TA. The sides 18' and 18" are spaced apart along the longitudinal axis a preselected amount; this dimension is selected so that the slot will permit the passage therethrough of a battery bolt shank.

The slot 18 extends from the edge of side 14' to a centrally positioned hole 18'" which has a diameter slightly larger than the longitudinal spacing of sides 18' and 18". The junction of the slot and the hole is identified by reference numeral 18S.

A plurality of grounding holes 24', 24", 24'" and 24"" are provided in the base portion 12. As shown, the grounding holes 24'–24"" are located equidistant from the center of the centrally positioned hole 18'"; they are arranged in sets of two, with each set of grounding holes being on opposite sides of the slot 18. Thus, grounding holes 24' and 24" are shown in FIG. 1 as being above the transverse axis TA and the second set 24'" and 24"" being below the transverse axis TA.

As indicated, the basic electrical terminal connector shown in FIGS. 1 and 1A has a plurality of uses. A first use is depicted in FIG. 4 wherein a side-mount type electrical storage battery 30 has a battery terminal 32 positioned in side 31 of the battery.

The battery side-terminal 32 has a substantially flat contact face 32AA in the center of which is a threaded female terminal 34, adapted to be threadedly engaged by the threaded shank portion 38 of a battery bolt 36 having a head 37.

FIG. 4 also depicts a battery cable 40 comprising a terminal 41 having a central aperture 41AA secured to one end of a cable 42, this being an arrangement representative of an application in a motor vehicle. The diameter of the aperture 41AA is preselected to permit the passage therethrough of the threaded shank 38 of battery bolt 36.

In order to show the versatility of my invention, FIG. 4 depicts a total of four of my unique connectors 10A, 10B, 10C and 10D arranged to be stacked one against the other and positioned between the flat face 32AA of the battery terminal and the terminal 41. It will be understood, of course, that in some cases only a single connector 10A would be used for a particular end use, while two or three could be used to meet the needs of the application. It will be noted from FIG. 4 that the male tabs 16'–16'" of 10A are aligned parallel to the top of the battery 30; the tabs of the next adjacent connector 10B are positioned vertically and pointing to the top of the battery; the male tabs of connector 10C are parallel with those of connector 10A but pointing in the opposite direction; and the tabs of connector 10D are pointing downwardly.

The male tabs 16'–16'" on the connectors 10A–10D are thus available for providing as shown, from one to twelve connection points for connecting external apparatus, not shown, to the battery terminal 32. Accordingly, to illustrate this versatility and capacity, in FIG. 4 a number of female connectors 50 of conventional design are shown connected to tab 16' of connector 10A to tab 16'" of connector 10B to tab 16" of connector 10C, and to all three tabs 16'–16'" of connector 10D.

Those skilled in the art will recognize that the number of male tabs on the connector could be greater than or lesser than the three tabs 16', 16" and 16'" shown in FIG. 1. I have found that having three male tabs as shown in FIG. 1 is very useful for many applications.

It will be appreciated that the connectors of my invention can be very quickly and safely utilized for the application depicted in FIG. 4. The user first turns the battery bolt 36 out a few turns to loosen the bolt from the threaded female terminal 34. Then the slot 18 of the connector is slipped onto the threaded shank 38; the slot 18 being sized to permit this action, following which the bolt is then tightened back into the terminal 34. At this point we have a connector immediately abutting and tightly clamped against the flat face 32AA of the terminal 32, providing a very efficient method of picking up power right at the battery side-post so as to minimize noise in associated connected communication equipment. The female connectors 50 can he connected to the male tabs either before or after the connectors are connected to the battery as aforesaid.

While all of the tabs 16'–16'" shown in FIG. 4 are coplanar with base portion, it will be understood by those skilled in the an that one or more of the tabs could be angled such as those shown in FIGS. 2 and 3.

The junction 18S of the slot and hole 18'" facilitates a holding function, i.e., holds the connectors 10 to the battery bolt shank 38.

Figure 6:
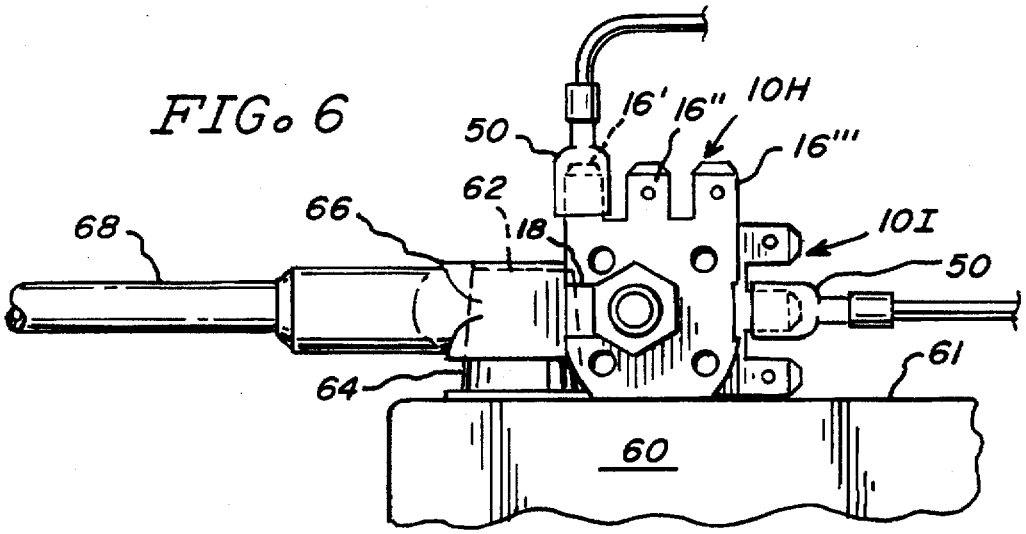

A second use of my unique connector is depicted in FIGS. 5 and 6 wherein a top-mount type electric storage battery 60 has a battery terminal 62 projecting up above the top 61 of the battery. The battery terminal 62 has the conventional tapered circumferential surface 64 for cooperation with and connection with a terminal 66 attached to the end of a battery cable 68. The terminal 66 has a pair of spaced apart arms or tabs 66AA and 66BB having bores therethrough to provide a passageway therethrough for a bolt 66B having a threaded shank 66B' on which is threaded a nut 66N which, when tightened on the shank 66B', will force the tabs 66AA and 66BB toward one another until the terminal 66 is tightly clamped mechanically and electrically to the battery terminal 62.

For this application or end use of my invention, I show, for illustrative purposes, two of my unique connectors 10H and 10I being clamped between the nut 66N and the tab 66BB of the battery cable terminal 66. As depicted, the tabs 16', 16" and 16'" of connector 1OH are shown to be perpendicular to the top surface 61 of the battery while the corresponding tabs of connector 10I are shown to be parallel to the top surface 61 of the battery. It will be understood that in this application also, the connectors can be very quickly and very safely connected to the battery terminal. The user first turns the nut 66N a few turns to provide some clearance between the nut and the tab 66B. Then the slots 18 of the connectors are slipped onto the threaded shank 66B', after which the nut 66N is tightened back to thereby clamp mechanically and electrically the connectors 1OH and 10I to the terminal 66. Again, excellent electrical contact is provided. Again the connector is firmly mechanically held in place. While FIGS. 5 and 6 show two connectors 10H and 10I, it will be understood, of course, that in some applications only a single connector would be used, while in other applications more than two connectors could be used for this utilization of my invention.

Another use, as aforesaid, of the electrical terminal connector of my invention is to have same used as a means for electrical connection to a metallic frame member such as the metallic frame or body pan of a motor vehicle.

Figure 3A:
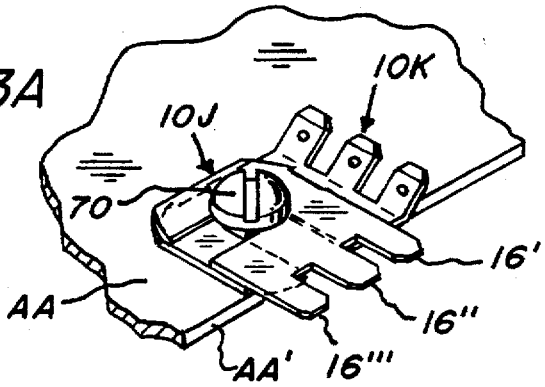
FIG. 3A shows another variation of the arrangement of FIG. 2 wherein two stacked connectors are connected to a metallic frame member with the connectors rotated approximately 90 degrees and with the stacked connectors being clamped against the metallic frame member by the use of a single large sheet metal screw passing through the centrally located hole in the slots of the two stacked connectors.

Three representative examples of this use of my invention are shown respectively in FIGS. 2, 3 and 3A. In these figures, a metallic frame or body part member is identified by the designator AA. In FIG. 2, a single connector 10E is electrically and mechanically connected to member AA through the use of a plurality of fastening means as sheet metal screws S passing through the holes or apertures 24'–24"". In FIG. 2, the tabs have been angled up away from the plane of the base portion to facilitate the connection thereto of a female connector 50.

In FIG. 3, the metallic frame member AA has an edge AA' and a pair of connectors 10F and 10G are stacked one against the other on top of member AA and positioned so that the male tabs 16'–16'" of the bottom connector 1 OF extend beyond the edge AA'. The upper connector 10G has its tabs angled similar to those shown in FIG. 2. Again, appropriate fastening means such as sheet metal screws S are used to electrically and mechanically connect the connectors to the metallic frame AA.

FIG. 3A shows another embodiment or end use of my invention. As was the case for FIGS. 2 and 3, the end use for FIG. 3A is to provide a means for electrical connection to a metallic frame member AA. Two of my unique connectors 10J and 10K are shown in stacked relationship but with the male tabs of connector 10J being oriented 90 degrees with respect to the male tabs of connector 10K. The stacked connectors 10J and 10K are mechanically and electrically connected to a frame member AA by use of a suitably sized fastening means such as a large sheet metal screw 70 passing through the central hole 18"" of slot 18 into the frame member AA. Again, the male tabs can either be in the same plane of the connector or they can be angled at a preselected angle such as 45 degrees. It will be noted that the connectors 10J and 10K of FIG. 3A do not have the holes or apertures 24'–24"", as they are not required for this end use of my invention.

I have found excellent results with a connector made in accordance with the following specifications and approximate dimensions:

Overall size (excluding male tabs) 1.0" by 1.0";

Slot width 0.332";

Hole 18'" 0.375";

Male tabs 0.25" wide (spaced from one another 0.125") and 0.3125" in longitudinal length; and Apertures 24'–24"" 0.187" diameter;

The material is a hardened brass alloy having a nominal thickness of 0.032";

The male tabs are tapered as shown at their extremities to facilitate entering a female connector.

The small holes 22'–22'" are nominally 0.0625".

The unique connector provided by my invention has inherent design strength for the intended connector uses, as well as economy in material cost. Thus, it will be noted in FIG. 1 that the top right and top left comers 11 and 13 have been rounded to save material. Also, the apertures 24'–24"" save material and do not adversely effect the mechanical strength of the device, even if one or more the apertures are not used in the usage of the device. A shallow notch 15 on the left hand side (as shown in FIG. 1 ) also saves some material without any functional sacrifice.

It will be seen that, for the uses or applications shown in FIGS. 4, 5 and 6, the apertures or holes 24'–24"" are not utilized and, on the other hand, the slot 18 is not required or utilized for the applications shown in FIGS. 2 and 3, although it is used for the application of FIG. 3A. However, it will be appreciated that by having both the apertures 24'–24"" and the slot 18, then the connector has the great versatility of uses as above described. While several embodiments of the invention have been illustrated, it will be understood that variations may be made by those skilled in the art without departing from the inventive concept. Accordingly, the invention is to be limited only by the scope of the following claims.

What is claimed as my invention is:

1. An electrical terminal connector comprising:

(i) a four-sided flat metal base portion having a preselected thickness and longitudinal and transverse axes;

(ii) at least two male terminal connection tabs depending from one side of said portion, parallel to said longitudinal axis and transversely spaced apart from one another; and (iii) a slot in said portion extending from the edge of a second side of said portion parallel to said transverse axis, said slot having a preselected width and connecting with and terminating at a centrally positioned hole formed in said portion.

2. Apparatus of claim 1 further characterized by the diameter of said centrally positioned hole being larger than said preselected width of said slot.

3. Apparatus of claim 1 further characterized by said base portion having two sets of two grounding holes therethrough located equidistant from the center of said centrally positioned hole.

4. Apparatus of claim 3 further characterized by each set of said two sets of grounding holes being on opposite sides of said slot.

5. Apparatus of claim 4 further characterized by the two holes of each set of said two sets being on a respective line parallel to said transverse axis.

6. An electrical terminal connector according to claim 1 wherein said male terminal connection tabs are angled from the plane defined by said flat base portion.

7. An electric terminal connector according to claim 6 wherein said male tabs are angled at approximately 45° from the plane defined by said flat base portion.

8. An electrical terminal connector for electrical connection with a threaded tap battery terminal of a side-mount electrical storage battery having a battery terminal bolt threaded into said tap, said electrical terminal connector comprising:

(i) a four-sided flat metal base portion having a preselected thickness and longitudinal and transverse axes;

(ii) at least two male terminal connection tabs depending from one side of said portion, parallel to said longitudinal axis and transversely spaced apart from one another, (iii) a slot in said portion extending from the edge of a second side of said portion parallel to said transverse axis, said slot having a preselected width and connecting with and terminating at a centrally positioned hole formed in said portion;

whereby said connector may be connected, as aforesaid, by (a) said battery bolt being initially loosened in said tap, (b) said connector being positioned adjacent to said threaded tap battery terminal and with said centrally positioned hole at the terminus of said slot of said base portion being closely adjacent to said battery bolt, and (c) said battery bolt being tightened in said tap, said preselected width of said slot being sufficient to permit said bolt to slide therethrough to said centrally positioned hole.

9. An electrical terminal connector for electrical connection to a metallic frame member, said connector comprising:

(i) a four-sided flat metal base portion having a preselected thickness and longitudinal and transverse axes;

(ii) at least two male terminal connection tabs depending from one side of said portion, parallel to said longitudinal axis and transversely spaced apart from one another;

(iii) a slot in said portion extending from the edge of a second side of said portion parallel to said transverse axis, said slot having a preselected width and connecting with and terminating at a centrally positioned hole formed in said portion;

(iv) at least two grounding holes in said base portion spaced from said centrally positioned hole;

whereby said connector may be connected, as aforesaid, by abutting said base portion against said metallic frame member, and fixing said base portion to said frame member by use of fastening means inserted through said grounding holes and attached to said metallic frame member.

10. An electrical terminal connector comprising:

(i) a four-sided flat metal base portion having a preselected thickness and longitudinal and transverse axes;

(ii) at least two male terminal connection tabs depending from one side of said portion, parallel to said longitudinal axis and transversely spaced apart from one another; and (iii) said base portion having a plurality of grounding holes therethrough.

11. An electrical terminal connector comprising:

(i) a four-sided flat metal base portion having a preselected thickness;

(ii) at least one male terminal connection tab depending from one side of said portion; and (iii) a slot in said portion extending from the edge of a second side of said portion, said slot having a preselected width and connecting with and terminating at a centrally positioned hole formed in said portion.

* * * * *